US008424487B2

(12) United States Patent
Cho et al.

(10) Patent No.: US 8,424,487 B2
(45) Date of Patent: Apr. 23, 2013

(54) ROLL-TO-ROLL PATTERNING APPARATUS AND PATTERNING SYSTEM HAVING THE SAME

(75) Inventors: Young Tae Cho, Suwon-si (KR); Sin Kwon, Suwon-si (KR); Ki Hyun Kim, Yongin-si (KR); Jung Woo Seo, Hwaseong-si (KR); Dong Min Kim, Suwon-si (KR); Jeong Gil Kim, Suwon-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 237 days.

(21) Appl. No.: 12/662,677

(22) Filed: Apr. 28, 2010

(65) Prior Publication Data

US 2010/0282162 A1 Nov. 11, 2010

(30) Foreign Application Priority Data

May 7, 2009 (KR) ..... 10-2009-0039577

(51) Int. Cl.
*B05C 11/00* (2006.01)
*B05C 1/00* (2006.01)
*B05C 1/06* (2006.01)

(52) U.S. Cl.
USPC ..... 118/712; 118/212; 118/256; 118/258; 118/642

(58) Field of Classification Search ..... 118/66, 118/211, 212, 256, 304, 419, 249, 250, 712, 118/713, 620, 258, 641–643; 427/162, 558, 427/167, 359; 359/443, 455, 459, 545, 599, 359/619; 264/405, 410, 494; 425/115, 174.4, 425/327; 430/320
See application file for complete search history.

(56) References Cited

U.S. PATENT DOCUMENTS

| | | | | |
|---|---|---|---|---|
| 6,373,636 | B1 * | 4/2002 | Conley | 359/619 |
| 2006/0210714 | A1 * | 9/2006 | Huizinga et al. | 427/359 |
| 2006/0236877 | A1 * | 10/2006 | Strand et al. | 101/6 |
| 2010/0072245 | A1 * | 3/2010 | Kim et al. | 226/189 |

* cited by examiner

*Primary Examiner* — Yewebdar Tadesse
(74) *Attorney, Agent, or Firm* — Harness, Dickey & Pierce, P.L.C.

(57) ABSTRACT

Disclosed herein is a roll-to-roll patterning apparatus and a patterning system using the same. The patterning system may include a supply roll to supply a film member, a recovery roll to recover the film member, and a roll-to-roll patterning apparatus forming a coating on the film member. The roll-to-roll patterning apparatus may include a pattern roller, a plurality of press rollers, and an alignment roller. The pattern roller may include an outer peripheral surface with a first pattern. The plurality of press rollers may press a film member against the pattern roller to form a second pattern on the film member. The alignment roller may be spaced apart from the pattern roller and may be arranged at an upstream position in a movement direction of the film member. The alignment roller may align the film member entering a region between the pattern roller and the plurality of press rollers.

20 Claims, 8 Drawing Sheets

ROLL-TO-ROLL PATTERNING APPARATUS AND PATTERNING SYSTEM HAVING THE SAME

CROSS-REFERENCE TO RELATED APPLICATION

This application claims priority under 35 U.S.C. §119 to Korean Patent Application No. 2009-0039577, filed on May 7, 2009 in the Korean Intellectual Property Office (KIPO), the entire contents of which is incorporated herein by reference.

BACKGROUND

1. Field

Example embodiments relate to a roll-to-roll patterning apparatus and a patterning system having the same, in which a patterned coating may be formed on a film member.

2. Description of the Related Art

A conventional roll-to-roll patterning apparatus is devised to form a patterned coating on a film member of flexible material. A conventional patterning system using the roll-to-roll patterning apparatus includes, in addition to the roll-to-roll patterning apparatus, a supply roll to supply a film member to the roll-to-roll patterning apparatus, and a recovery roll to recover the film member upon which a coating has been completely formed by the roll-to-roll patterning apparatus. The conventional roll-to-roll patterning apparatus forms a patterned coating on the film member that is moving between the supply roll and the recovery roll.

The conventional roll-to-roll patterning apparatus includes a pattern roller, an outer peripheral surface of which is formed with a pattern to be formed on the coating, a resin supply device to supply resin for formation of the coating between the pattern roller and the film member, and a press roller to press the film member against the pattern roller so as to form the pattern on the resin of the film member.

In the above-described conventional roll-to-roll patterning apparatus, however, the film member may be easily deformed by heat or force acting thereupon during formation of the patterned coating. When the film member is deformed, forming a pattern at an accurate position and with a desired shape may be difficult. Therefore, it may be difficult to form an accurately patterned coating using the conventional roll-to-roll patterning apparatus.

SUMMARY

Example embodiments provide a roll-to-roll patterning apparatus and a patterning system having the same, wherein a relatively accurately patterned coating may be formed on a film member.

Example embodiments will be set forth in part in the description which follows and, in part, will be obvious from the description, or may be learned by practice of the invention.

In accordance with example embodiments, a roll-to-roll patterning apparatus may include a pattern roller, a plurality of press rollers, and an alignment roller. The pattern roller may include an outer peripheral surface with a first pattern. The plurality of press rollers may press a film member against the pattern roller to form a second pattern on the film member. The alignment roller may be spaced apart from the pattern roller and may be arranged at an upstream position in a movement direction of the film member. The alignment roller may align the film member entering a region between the pattern roller and the plurality of press rollers.

In accordance with example embodiments, a patterning system may include a supply roll to supply a film member, a recovery roll to recover the film member on which a coating is completely formed, and a roll-to-roll patterning apparatus forming the coating on the film member moving from the supply roll to the recovery roll. In accordance with example embodiments, the roll-to-roll patterning apparatus may include a pattern roller, a plurality of press rollers, and an alignment roller. The pattern roller may include an outer peripheral surface with a first pattern. The plurality of press rollers may press a film member against the pattern roller to form a second pattern on the film member. The alignment roller may be spaced apart from the pattern roller and may be arranged at an upstream position in a movement direction of the film member. The alignment roller may align the film member entering a region between the pattern roller and the plurality of press rollers.

In accordance with example embodiments, a roll-to-roll patterning apparatus may include a pattern roller, an outer peripheral surface of which is formed with a pattern corresponding to a pattern of a coating to be formed on a film member, a plurality of press rollers to press the film member against the pattern roller, and an alignment roller spaced apart from the pattern roller opposite thereto at an upstream position in a movement direction of the film member and serving to align the film member entering between the pattern roller and the press rollers.

The alignment roller may be arranged in a direction parallel to an axis of the pattern roller so as to reciprocally move to or from the pattern roller and may be tiltable by a predetermined or preset angle with respect to the axis of the pattern roller arranged parallel thereto.

The roll-to-roll patterning apparatus may further include a resin supply device to supply resin between the pattern roller and the film member, and a curing device to cure resin on the film member.

The resin may include a photo curable resin, and the curing device may include a light source to irradiate light to the photo curable resin for curing of the resin.

The roll-to-roll patterning apparatus may further include a resin supply device to supply photo curable resin between the pattern roller and the film member, and a light source to irradiate light to the photo curable resin for curing of the resin.

The light source may irradiate light to the film member passing between a pair of ones of the plurality of press rollers located at the most downstream positions in the movement direction of the film member.

The roll-to-roll patterning apparatus may further include a partial curing device to cure only a part of the photo curable resin on the film member before the light source cures the photo curable resin.

The partial curing device may include an auxiliary light source to irradiate light to the photo curable resin on the film member, and a shield film to intercept a part of the light emitted from the auxiliary light source.

The shield film may be wound on the alignment roller and one of the plurality of press rollers located at the most upstream position in the movement direction of the film member, and the auxiliary light source may irradiate light, through the shield film, to the photo curable resin on the film member moving between the alignment roller and the press roller located at the most upstream position in the movement direction of the film member.

The shield film may be wound on a pair of ones of the plurality of press rollers located at the most upstream positions in the movement direction of the film member, and the auxiliary light source may irradiate light to the photo curable resin on the film member passing between the pair of ones of the plurality of press rollers located at the most upstream positions in the movement direction of the film member.

The shield film may include a shielding portion centrally provided in a width direction thereof to intercept the light emitted from the auxiliary light source, and transmitting portions provided at opposite sides in the width direction of the shielding portion to permit transmission of the light.

The outer peripheral surface of the pattern roller may be provided with a plurality of first alignment marks circumferentially spaced apart from one another by a constant distance, the film member may be provided with a plurality of second alignment marks longitudinally spaced apart from one another by a constant distance, and the roll-to-roll patterning apparatus may further include a plurality of sensing devices to sense the first alignment marks and the second alignment marks.

The plurality of sensing devices may sense any one of the plurality of first alignment marks and any one of the second alignment marks simultaneously.

The plurality of sensing devices may include a first sensing device to sense any one of the plurality of first alignment marks and a second sensing device to sense any one of the plurality of second alignment marks.

The sensing devices may include cameras to recognize image information.

The plurality of first alignment marks may be provided on the outer peripheral surface at opposite sides in an axial direction of the pattern roller, and the plurality of second alignment marks may be provided at opposite sides in a width direction of the film member.

In accordance with example embodiments, a patterning system may include a supply roll to supply a film member, a recovery roll to recover the film member on which a coating is completely formed, and a roll-to-roll patterning apparatus to form the coating on the film member moving from the supply roll to the recovery roll, and the roll-to-roll patterning apparatus may include a pattern roller, an outer peripheral surface of which is formed with a pattern corresponding to a pattern of the coating formed on a film member, a plurality of press rollers to press the film member against the pattern roller, and an alignment roller spaced apart from the pattern roller opposite thereto at an upstream position in a movement direction of the film member and serving to align the film member entering between the pattern roller and the press rollers.

BRIEF DESCRIPTION OF THE DRAWINGS

Example embodiments will be more clearly understood from the following detailed description taken in conjunction with the accompanying drawings.

FIG. 1 is a schematic view of a patterning system according to example embodiments;

FIG. 2 is a schematic view of a roll-to-roll patterning apparatus included in the patterning system according to example embodiments;

FIG. 3 is a schematic perspective view of the roll-to-roll patterning apparatus according to example embodiments;

FIG. 4 is a schematic view of the roll-to-roll patterning apparatus showing tilting of an alignment roller according to example embodiments;

FIG. 5 is a schematic view of a shield film included in the roll-to-roll patterning apparatus according to example embodiments;

FIG. 6 is a schematic view of a roll-to-roll patterning apparatus according to example embodiments;

FIG. 7 is a schematic view of a roll-to-roll patterning apparatus according to example embodiments; and FIG. 8 is a schematic view of a roll-to-roll patterning apparatus according to example embodiments.

DETAILED DESCRIPTION

Figure 1:
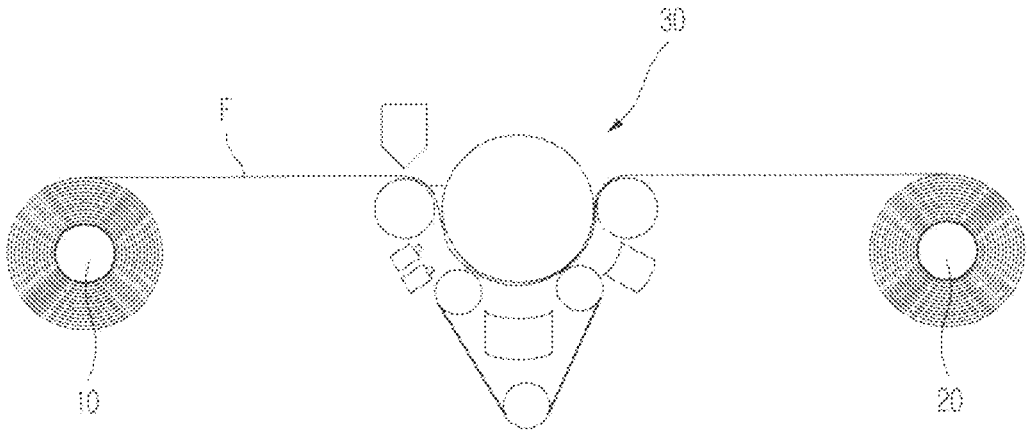
FIGS. 1-8 represent non-limiting, example embodiments as described herein. In the figures.

Example embodiments will now be described more fully with reference to the accompanying drawings, in which example embodiments are shown. The invention may, however, be embodied in different forms and should not be construed as limited to example embodiments set forth herein. Rather, example embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on", "connected to", or "coupled to" another element or layer, it can be directly on, connected to, or coupled to the other element or layer or intervening elements or layers that may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. Thus, a first element, component, region, layer, or section discussed below could be termed a second element, component, region, layer, or section without departing from the teachings of example embodiments.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configuration formed on the basis of manufacturing processes. Therefore, regions exemplified in figures have schematic properties and shapes of regions shown in figures exemplify specific shapes or regions of elements, and do not limit example embodiments. Reference will now be made in detail to example embodiments which are illustrated in the accompanying drawings, wherein like reference numerals refer to like elements throughout.

Referring to FIG. 1, the patterning system according to example embodiments may include a supply roll 10 on which a film member to be coated may be wound, a recovery roll 20 on which a film member F having a coating completely formed thereon may be wound, and a roll-to-roll patterning apparatus 30 arranged between the supply roll 10 and the recovery roll 20. In example embodiments, the roll-to-roll patterning apparatus 30 may serve to form a patterned coating on the film member F that may move from the supply roll 10 to the recovery roll 20.

Figure 2:
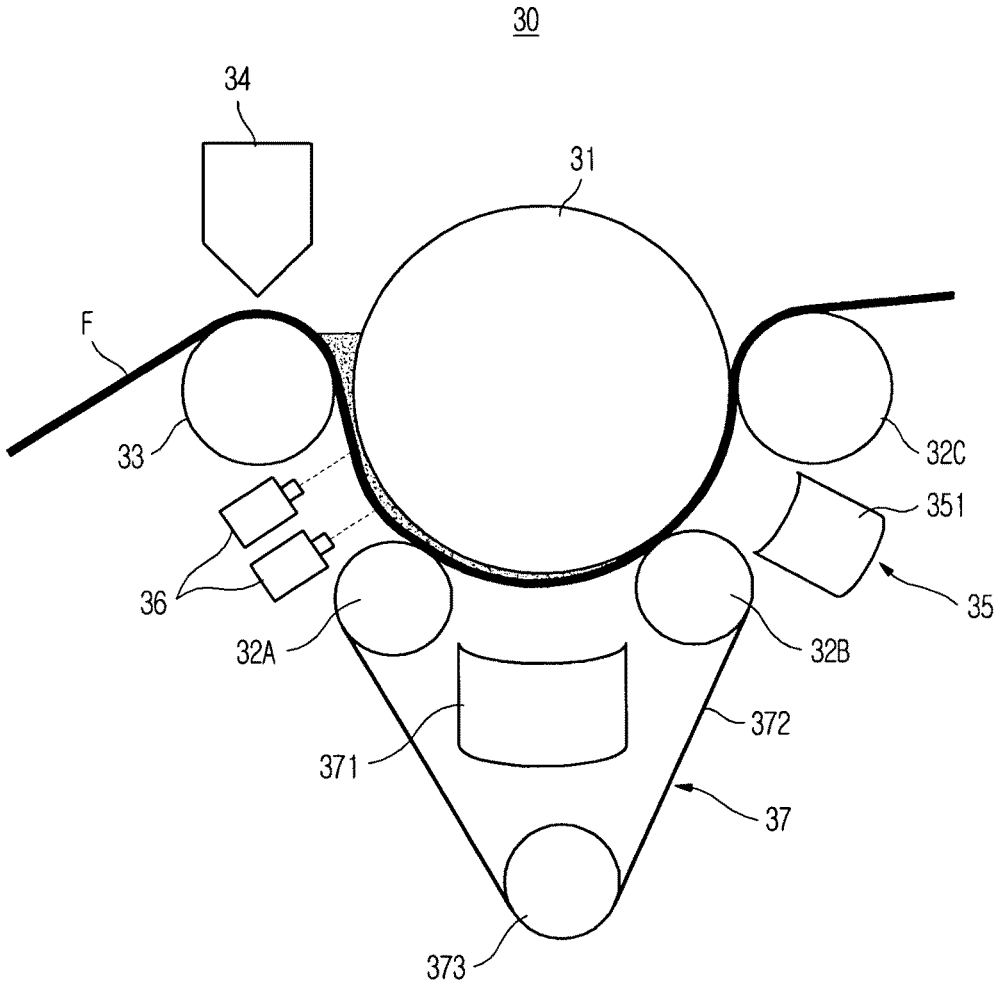

Referring to FIG. 2, the roll-to-roll patterning apparatus 30 may include a pattern roller 31, a plurality of press rollers 32A, 32B and 32C, an alignment roller 33, a resin supply device 34, and a curing device 35. The pattern roller 31 may have an outer peripheral surface that may be formed with a pattern having a shape corresponding to a pattern of a coating to be formed on the film member F. The plurality of press rollers 32A, 32B and 32C may be configured to press the film member F against the pattern roller 31 so as to allow a patterned coating to be formed on the film member F. The alignment roller 33 may be arranged upstream of the press rollers 32A, 32B and 32C in a movement direction of the film member F to align the film member F entering between the pattern roller 31 and the press rollers 32A, 32B and 32C. The resin supply device 34 may be configured to supply resin for formation of a coating between the pattern roller 31 and the film member F. The curing device 35 may be configured to cure resin applied to the film member F so as to form the coating. In example embodiments, the resin used for formation of the coating may be a UV photo curable resin that may be cured upon receiving UV light, and the curing device 35 may include a light source 351 to emit UV light.

In operation, the resin supply device 34 supplies resin onto the film member F approaching on the pattern roller 31, to apply the resin to a surface of a section of the film member F. The film member F having the applied resin may be aligned by the alignment roller 33 and the film member F may enter between the pattern roller 31 and the press roller 32A. The resin applied to the film member F may be pressed by the plurality of press rollers 32A, 32B and 32C and may be cured upon receiving light emitted from the light source 351 of the curing device 35. Thereby, a patterned coating may be formed on the film member F.

Figure 4:
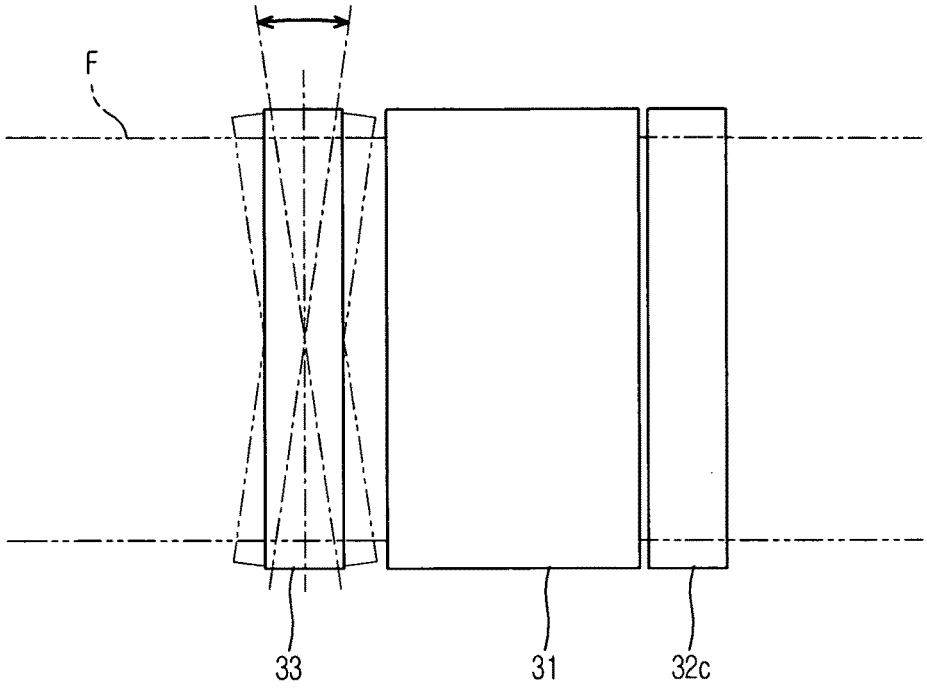

The alignment roller 33 may be arranged in a direction parallel to an axial direction of the pattern roller 31 and may be configured to reciprocally move to or from the pattern roller 31. Also, the alignment roller 33 arranged parallel to the pattern roller 31 may be tilted as shown in FIG. 4 to have a predetermined or preset angle with respect to the pattern roller 31. With reciprocal movement and tilting of the alignment roller 33, the film member F may enter between the pattern roller 31 and the press rollers 32A, 32B and 32C with an increased accuracy, thus enabling formation of a relatively accurate patterned coating thereon.

Figure 3:
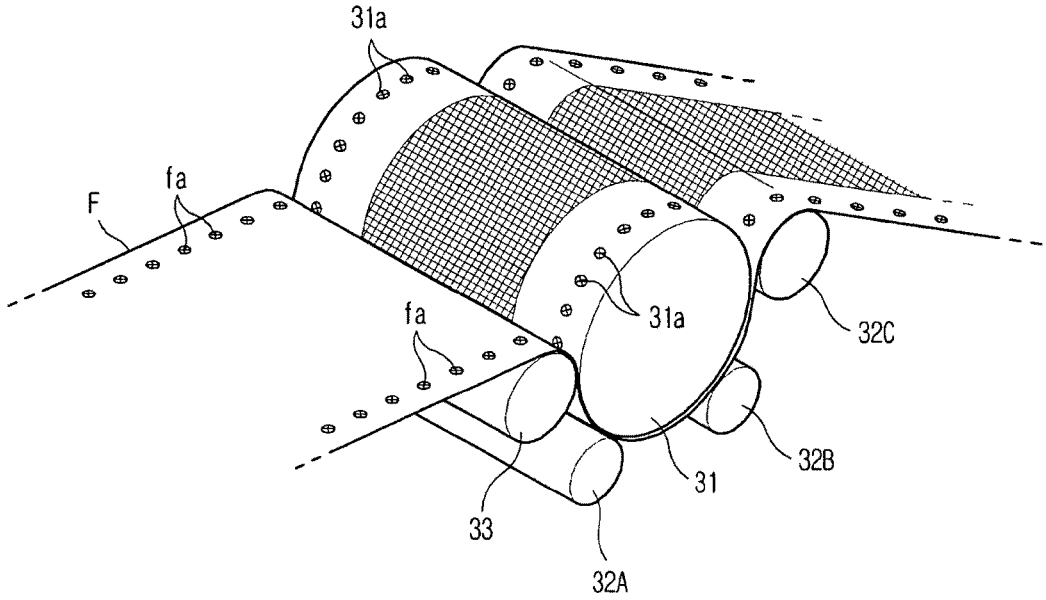

Referring to FIG. 3, an outer peripheral surface of the pattern roller 31 may be provided with a plurality of first alignment marks 31*a* such that the first alignment marks 31*a* are circumferentially spaced apart from one another by a constant distance. The first alignment marks 31*a* may serve to facilitate alignment of the film member F by the alignment roller 33. The first alignment marks 31*a* may be located at opposite sides in an axial-direction of the pattern roller 31. The film member F may be provided with a plurality of second alignment marks fa such that the second alignment marks fa are longitudinally spaced apart from each other by a constant distance to correspond to the first alignment marks 31*a*. The second alignment marks fa may be located at opposite sides in a width-direction of the film member F.

Referring back to FIG. 2, the roll-to-roll patterning apparatus 30 may include sensing devices 36, which may sense the first alignment marks 31*a* and second alignment marks fa. Accordingly, the sensing devices 36 may sense relative positions between the first alignment marks 31*a* on the pattern roller 31 and the second alignment marks fa on the film member F, thereby causing the reciprocal movement and tilting of the alignment roller 33. In example embodiments, the sensing devices 36 may take the form of cameras to recognize image information. The sensing devices 36 may be arranged between the alignment roller 33 and the most upstream one 32A of the plurality of press rollers 32A, 32B and 32C and may serve to simultaneously recognize the first alignment marks 31*a* on the pattern roller 31 and the second alignment marks fa on the film member F moving along the pattern roller 31. There may be provided a total of four sensing devices 36 to sense positions of the first alignment marks 31*a* and second alignment marks fa in such a manner that two sensing devices are arranged in parallel in a width direction of the film member F and two sensing devices are arranged in parallel in a movement direction of the film member F.

Sensing the first alignment marks 31*a* and second alignment marks fa simultaneously using the sensing devices 36 as described above may require a relatively high sensing accuracy, thus assuring delicate alignment by the alignment roller 33. Therefore, example embodiments may be particularly useful when it is desired to form a coating with a high accuracy pattern on the film member F.

In example embodiments, a total of three press rollers 32A, 32B and 32C may be provided. Although example embodiments describe the use of three press rollers, example embodiments are not limited thereto. For example, there may be more or less than three press rollers used with roll-to-roll patterning apparatus 30. The curing device 35 may be used to cure the resin on the film member F passing between the two press rollers 32B and 32C located downstream in the movement direction of the film member F, thereby forming a coating on the film member F. In addition, a partial curing device 37 may be provided to cure a part of the resin on the film member F moving between the two press rollers 32A and 32B located upstream in the movement direction of the film member F.

The partial curing device 37 may serve to assist not only effective formation of a coating, but also smooth movement of the film member F by the alignment roller 33. The partial curing device 37 may include an auxiliary light source 371, a shield film 372, and a drive roller 373. The auxiliary light source 371 may cure the resin on the film member F. The shield film 372 may have both ends wound on the two upstream ones 32A and 32B of the plurality of press rollers 32A, 32B and 32C and may serve to allow only a part of light emitted from the auxiliary light source 371 to selectively reach the film member F. The drive roller 373 may circulate the shield film 372 around the two press rollers 32A and 32B.

Figure 5:
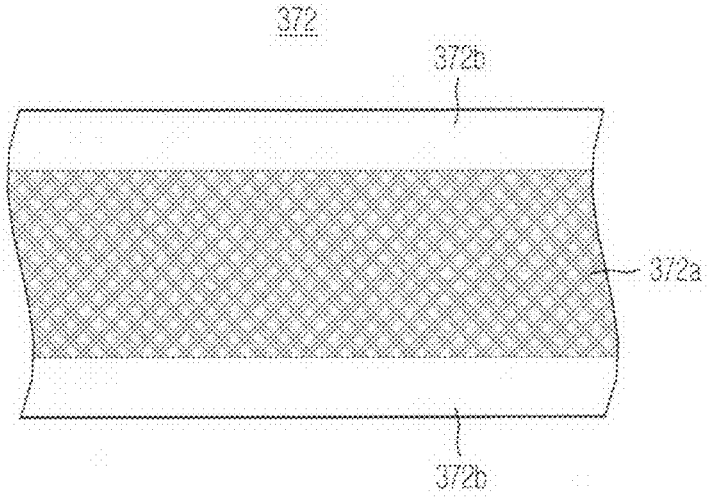

Referring to FIG. 5, the shield film 372 may include a shielding portion 372*a* and transmitting portions 372*b*. The shielding portion 372*a* may be centrally provided in a width direction thereof to intercept the light emitted from the auxiliary light source 371. The transmitting portions 372*b* may be provided at width-direction opposite sides of the shielding portion 372*a* to permit transmission of the light. Thus, a part of the light emitted from the auxiliary light source 371 may be intercepted by the shielding portion 372*a*, and only the remaining partial light reaches the partial resin applied to opposite partial regions in the width direction of the film member F through the transmitting portions 372*a*. Thereby, only the partial resin applied to the partial regions of the film member F at opposite sides in the width direction of the film member F may be selectively cured to form a coating.

The coating may be first formed only on the partial regions of the film member F at opposite sides in the width direction of the film member F by the partial curing device 37 and the film member F may be smoothly moved by the alignment roller 33. This may contribute to formation of an accurately patterned coating on the film member F.

Figure 6:
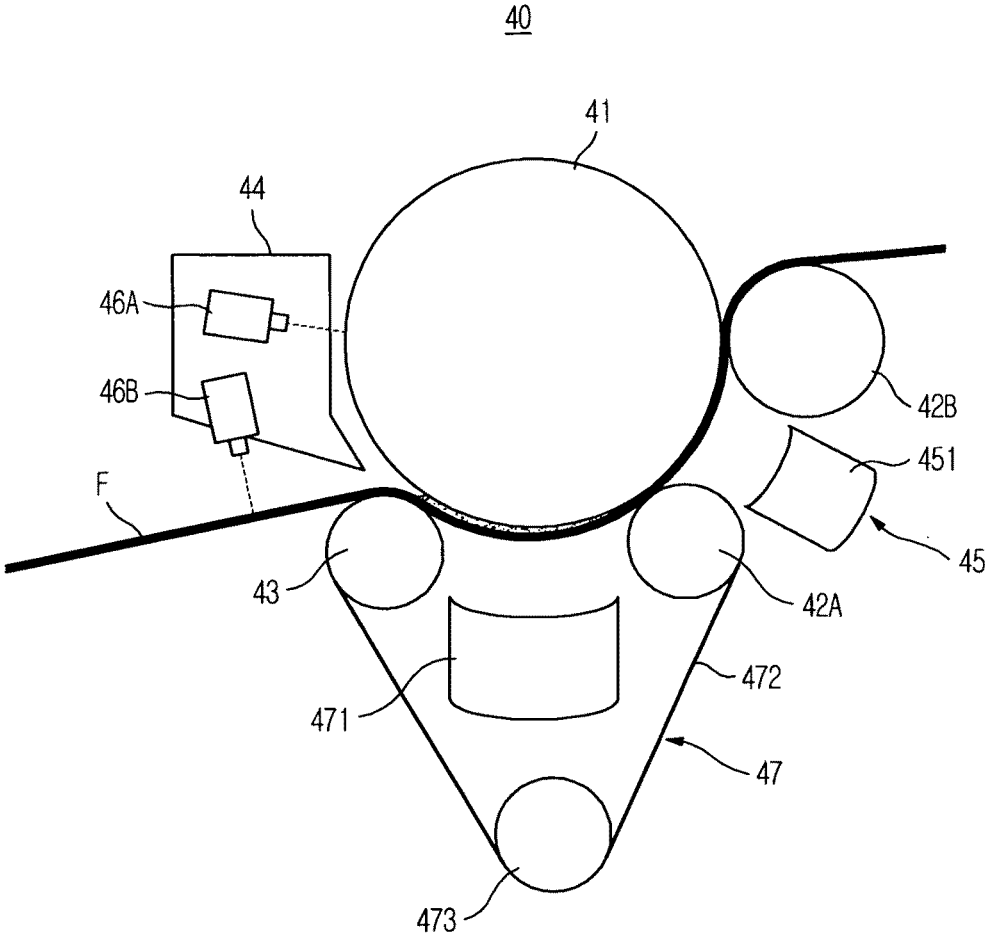

Referring to FIG. 6, a roll-to-roll patterning apparatus 40 according to example embodiments may include a pattern roller 41, a pair of press rollers 42A and 42B, an alignment roller 43, and a resin supply device 44.

Both ends of a shield film 472 of a partial curing device 47 may be wound on the alignment roller 43 and an upstream one of the pair of press rollers 42A and 42B in a movement direction of the film member F, such that the shield film 472 is circulated by a drive roller 473. An auxiliary light source 471 of the partial curing device 47 may irradiate light to the film member F that is moving between the alignment roller 43 and the upstream press roller 42A. Thus only a part of the resin on the film member F moving between the alignment roller 43 and the upstream press roller 42A may be cured by the partial curing device 47.

A light source 451 of a curing device 45 may irradiate light to the film member F that is moving between the two press rollers 42A and 42B. Thus, the resin on the film member F moving between the two press rollers 42A and 42B may be cured completing a formation of a patterned coating.

Sensing devices 46A and 46B may include a first sensing device 46A to sense first alignment marks (not shown) on the pattern roller 41 individually, and a second sensing device 46B to sense second alignment marks (not shown) on the film member F individually. By individually sensing the first alignment marks and second alignment marks, it may be possible to predict movement of the film member F, thus allowing the alignment roller 43 to align the film member F based on the predicted movement. This may be used when it is desired to form a coating with a relatively low accuracy pattern on the film member F.

Figure 7:
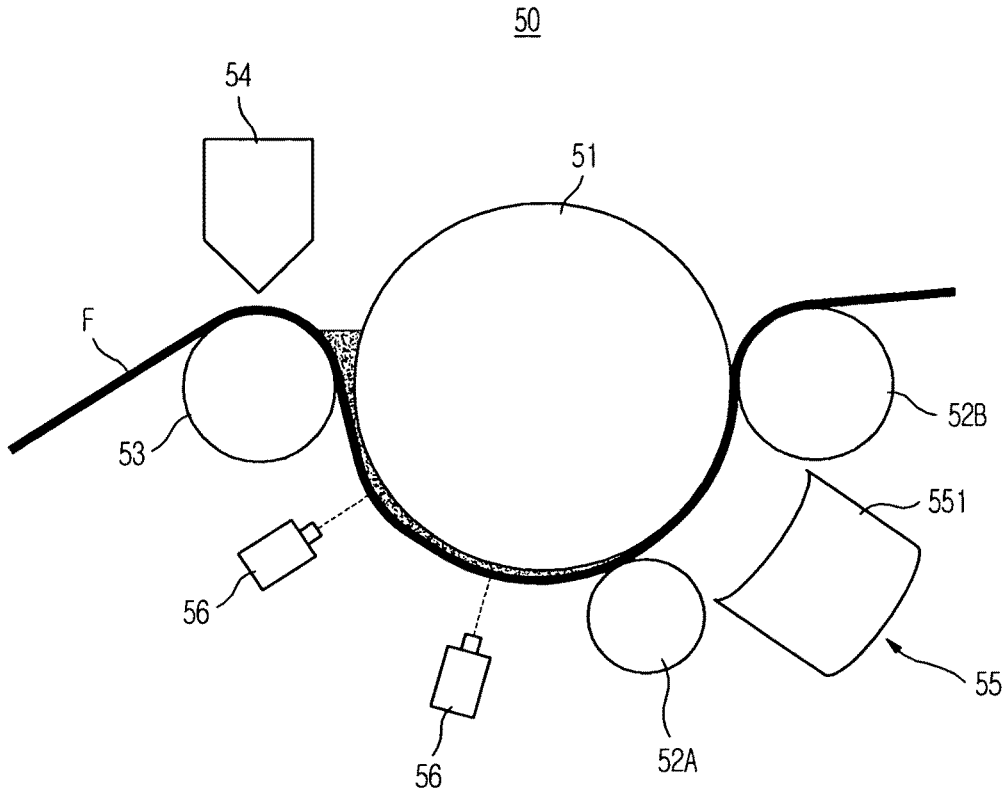

Referring to FIG. 7, a roll-to-roll patterning apparatus 50 according to example embodiments may include a pattern roller 51, a pair of press rollers 52A and 52B, an alignment roller 53, and a resin supply device 54.

A light source 551 of a curing device 55 may irradiate light to the film member F that is moving between the two press members 52A and 52B, thus the resin on the film member F moving between the two press rollers 52A and 52B may be cured completing a formation of a patterned coating.

A sensing device 56 may be located between the alignment roller 53 and an upstream one 52A of the pair of press rollers 52A and 52B in a movement direction of the film member F, and may serve to simultaneously sense first alignment marks (not shown) formed on the pattern roller 51 and second alignment marks (not shown) formed on the film member F.

The roll-to-roll patterning apparatus 50 illustrated in FIG. 7 does not have an element corresponding to the partial curing device of roll-to-roll patterning apparatuses 30 and 40 illustrated in FIGS. 2 and 5.

Figure 8:
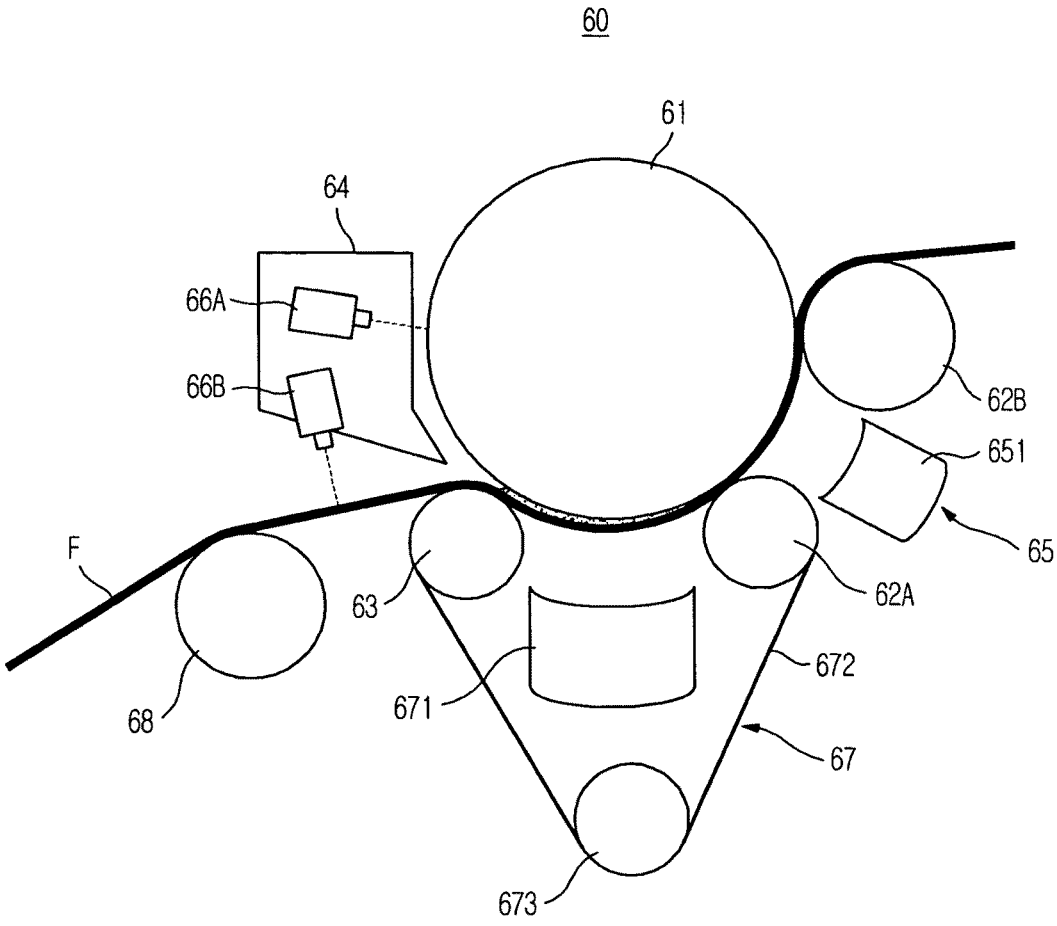

Referring to FIG. 8, a roll-to-roll patterning apparatus 60 according to example embodiments may include a pattern roller 61, a pair of press rollers 62A and 62B, an alignment roller 63, and a resin supply device 64.

Both ends of a shield film 672 of a partial curing device 67 may be wound on the alignment roller 63 and an upstream one 62A of the pair of press rollers 62A and 62B in a movement direction of the film member F, such that the shield film 672 is circulated by a drive roller 673. An auxiliary light source 671 of the partial curing device 67 may irradiate light to the film member F that is moving between the alignment roller 63 and the upstream press roller 62A, thus curing a part of the resin on the film member F moving between the alignment roller 63 and the upstream press roller 62A.

A light source 651 of a curing device 65 may irradiate light to the film member F that is moving between the two press rollers 62A and 62B, thus the resin on the film member F moving between the two press rollers 62A and 62B may be cured completing a formation of a patterned coating.

Sensing devices 66A and 66B may include a first sensing device 66A to sense first alignment marks (not shown) on the pattern roller 61 individually, and a second sensing device 66B to sense second alignment marks (not shown) on the film member F individually. By individually sensing the first alignment marks and second alignment marks, it may be possible to predict movement of the film member F, thus allowing the alignment roller 63 to align the film member F based on the predicted movement.

In example embodiments, a preliminary alignment roller 68 may be provided upstream of the alignment roller 63 in a movement direction of the film member F. Thus, the film member F may be primarily aligned by the preliminary alignment roller 68, prior to moving between the pattern roller 61 and the alignment roller 63.

The preliminary alignment roller 68 may serve to assure not only a substantially predictable alignment, but also formation of a more accurately patterned coating on the film member F. Similar to the alignment roller 63, the preliminary alignment roller 68 may be arranged in a direction parallel to an axial direction of the pattern roller 61 so as to reciprocally move to or from the pattern roller 61. The preliminary alignment roller 68 may be arranged parallel to the pattern roller 61 and may be tilted to have a predetermined angle with respect to the pattern roller 61 and may serve to move the film member F via movement thereof.

The preliminary alignment roller 68 may be used in a case where the sensing devices 66A and 66B have difficulty simultaneously sensing the first alignment marks on the pattern roller 61 and the second alignment marks on the film member F due to the installation configuration of the roll-to-roll patterning device 60 although it may be necessary to form an accurately patterned coating on the film member F.

Although the preliminary alignment roller 68 is shown only in FIG. 8, the preliminary alignment roller 68 may also be used with the roll-to-roll patterning apparatuses illustrated in FIGS. 2, 5, and 6 such that the preliminary alignment roller 68 may be located upstream of the alignment rollers 33, 43 or 53 in the movement direction of the film member F for more accurate alignment of the film member F.

In example embodiments, further, although the resin may be a UV photo curable resin and the curing device may include a light source to emit UV light, example embodiments are not limited thereto. For example, various kinds of photo curable resins to be cured by various kinds of light may be used and the curing device may include various kinds of light sources to emit light required to cure the corresponding photo curable resin.

As is apparent from the above description, in a roll-to-roll patterning apparatus and a patterning system having the same, an alignment roller may be used to align a film member, so as to guide the film member between a pattern roller and a press roller. This may assure movement of the film member to a relatively accurate position, resulting in formation of a film member having a relatively accurate patterned coating.

Although example embodiments have been shown and described, it would be appreciated by those skilled in the art that changes may be made in these embodiments without departing from the principles and spirit of the invention, the scope of which is defined in the claims and their equivalents.

What is claimed is:

1. A roll-to-roll patterning apparatus, comprising:

a pattern roller including an outer peripheral surface with a first pattern;

a plurality of press rollers pressing a film member against the pattern roller to form a second pattern on the film member;

an alignment roller spaced apart from the pattern roller and arranged at an upstream position in a movement direction of the film member, the alignment roller aligning the film member entering a region between the pattern roller and the plurality of press rollers; and a plurality of sensing devices to sense a plurality of first alignment marks and a plurality of second alignment marks, wherein the plurality of first alignment marks are circumferentially spaced around the outer peripheral surface of the pattern roller, and the plurality of second alignment marks are longitudinally spaced along the film member.

2. The apparatus according to claim 1, wherein the alignment roller is arranged in a direction parallel to an axis of the pattern roller, the alignment roller being configured to reciprocally move towards and away from the pattern roller and being further configured to tilt by an angle with respect to the axis of the pattern roller.

3. The apparatus according to claim 1, further comprising:

a resin supply device supplying resin on the film member and between the pattern roller and the film member; and a curing device configured to cure the resin on the film member.

4. The apparatus according to claim 3, wherein the resin includes photo curable resin, and the curing device includes a light source configured to irradiate light to the photo curable resin to cure the resin.

5. The apparatus according to claim 4, wherein the light source irradiates light to the film member passing between a pair of press rollers among the plurality of press rollers, the pair of press rollers being located at a first most downstream position and a second most down stream position in the movement direction of the film member.

6. The apparatus according to claim 5, further comprising:

a partial curing device configured to cure only a part of the photo curable resin on the film member.

7. The apparatus according to claim 6, wherein the partial curing device includes an auxiliary light source configured to irradiate light to the photo curable resin on the film member, and a shield film configured to intercept a part of the light emitted from the auxiliary light source.

8. The apparatus according to claim 7, wherein the shield film is wound on the alignment roller and one press roller among the plurality of press rollers, the one press roller being located at a most upstream position in the movement direction of the film member, and the auxiliary light source irradiates light, through the shield film, to the photo curable resin on the film member moving between the alignment roller and the one press roller.

9. The apparatus according to claim 7, wherein the shield film is wound on a pair press rollers of the plurality of press rollers, the pair of press rollers being located at a first most upstream position and a second most upstream position in the movement direction of the film member, and the auxiliary light source irradiates light to the photo curable resin on the film member passing between the pair of press rollers.

10. The apparatus according to claim 7, wherein the shield film includes a shielding portion centrally provided in a width direction of the shield film to intercept the light emitted from the auxiliary light source, and transmitting portions at opposite sides of the shield film in the width direction of the shield film to permit transmission of the light from the auxiliary light source to the film member.

11. The apparatus according to claim 1, wherein the plurality of sensing devices are configured to sense any one of the plurality of first alignment marks and any one of the plurality of second alignment marks simultaneously.

12. The apparatus according to claim 11, wherein the sensing devices include cameras configured to recognize image information.

13. The apparatus according to claim 1, wherein the plurality of sensing devices includes a first sensing device configured to sense any one of the plurality of first alignment marks and a second sensing device configured to sense any one of the plurality of second alignment marks.

14. The apparatus according to claim 1, wherein the plurality of first alignment marks is provided on the outer peripheral surface at opposite sides in an axial direction of the pattern roller, and the plurality of second alignment marks is provided at opposite sides in a width direction of the film member.

15. A patterning system comprising:

a supply roll to supply a film member;

a recovery roll to recover the film member on which a coating is completely formed; and a roll-to-roll patterning apparatus forming the coating on the film member moving from the supply roll to the recovery roll, wherein the roll-to-roll patterning apparatus includes a pattern roller including an outer peripheral surface with a first pattern, a plurality of press rollers pressing the film member against the pattern roller to form a second pattern on the film member, and an alignment roller spaced apart from the pattern roller and arranged at an upstream position in a movement direction of the film member, the alignment roller aligning the film member entering a region between the pattern roller and the plurality of press rollers, wherein the outer peripheral surface of the pattern roller includes a plurality of first alignment marks circumferentially spaced apart from one another, the film member includes a plurality of second alignment marks longitudinally spaced apart from one another, and the roll-to-roll patterning apparatus further includes a plurality of sensing devices to sense the plurality of first alignment marks and the plurality of second alignment marks.

16. The system according to claim 15, wherein the alignment roller is arranged in a direction parallel to an axis of the pattern roller, the alignment roller being configured to reciprocally move towards and away from the pattern roller and being further configured to tilt by an angle with respect to the axis of the pattern roller.

17. The system according to claim 15, wherein the roll-to-roll patterning apparatus further includes a resin supply device supplying resin on the film member and between the pattern roller and the film member, and a curing device configured to cure the resin on the film member.

18. The system according to claim 17, wherein the resin includes photo curable resin, and the curing device includes a light source configured to irradiate light to the photo curable resin to cure the resin.

19. The system according to claim 18, wherein the roll-to-roll patterning apparatus further includes a partial curing device configured to cure only a part of the photo curable resin on the film member.

20. The system according to claim 19, wherein the partial curing device includes an auxiliary light source configured to irradiate light to the photo curable resin on the film member, and a shield film configured to intercept a part of the light emitted from the auxiliary light source.

* * * * *